US005581949A

United States Patent [19]

Wu

[11] Patent Number: 5,581,949

[45] Date of Patent: Dec. 10, 1996

[54] THRESHOLD ASSEMBLY

[76] Inventor: Ming-Hsin Wu, 20, Lane 92, Shing Ell St., Tao Yuan City, Tao Yuan County, Taiwan

[21] Appl. No.: 552,129

[22] Filed: Nov. 2, 1995

[51] Int. Cl.[6] ..... E06B 1/70

[52] U.S. Cl. ..... 49/467

[58] Field of Search ..... 49/467, 61, 70, 49/469, 470

[56] References Cited

U.S. PATENT DOCUMENTS

| | | | |
|---|---|---|---|
| 3,148,419 | 9/1964 | Straus et al. | 49/469 |
| 3,654,730 | 4/1972 | Fraleigh | 49/467 X |
| 4,079,550 | 3/1978 | Bursk et al. | 49/467 |
| 4,104,830 | 8/1978 | Eagle | 49/469 X |
| 4,387,535 | 6/1983 | Corbo | 49/469 X |

*Primary Examiner*—Philip C. Kannan
*Attorney, Agent, or Firm*—Bacon & Thomas

[57] ABSTRACT

A threshold assembly may be installed without requiring wet cement and after a door frame and adjoining wall structure are completed by first securing an inner bushing and securing plate to the ground at the threshold location and securing an elongate threshold base to plate and bushing by engaging outwardly extending flanges of the plate with hooks provided on the inner walls of the base. A cover plate may be secured on the top surface of the base by engaging inwardly extending flanges of the cover plate within corresponding longitudinally extending grooves on the base.

5 Claims, 3 Drawing Sheets

THRESHOLD ASSEMBLY

BACKGROUND OF THE INVENTION (a) Field of the Invention

The present invention relates to a threshold assembly for blocking water, and particularly to a structure which does not require wet cement and is suitable for dry installation.

(b) Description of the Prior Art

Conventional thresholds for blocking water can be made of man-made marble, stainless steel or constructed of concrete and cement. However, the construction work of the above-mentioned conventional thresholds has to be executed during the course of laying the door frames. This means that the installation work involves first mixing the concrete and piling the bricks, and thereafter the prefabricated marble or stainless steel threshold is attached to the wet cement. This is the so-called wet-typed cement construction of the threshold. The threshold cannot be installed after the door frames and painting are completed. For this type of installation, it takes longer to build the threshold because of the heavy cement work involved. In addition, the cement work could be damaged by external vibration before it dries out, thereby causing a gap (for leakage) in the threshold construction. Nonetheless, the physical sizes of the marble, stainless steel and bricks are bulky, making it hard for transportation.

SUMMARY OF THE INVENTION

The main object according to the present invention is to provide a plastic threshold for blocking water. The structure consists of a plastic hollow threshold base and an inner bushing cooperating with a metallic securing plate. The inner bushing and the securing plate can be secured on the ground by fastening components, thereby allowing the threshold base to be inserted from the top into the inner bushing for securing. Bonding glue can be applied to enhance the securing of the structure. The structure can be easily installed after the door frames and walls are completed and painted, thereby overcoming the inconvenience of traditional wet cement construction.

Another object according to the present invention is to provide a plastic threshold for blocking water, in which retaining slots are provided in selected locations on both ends of the threshold base. Such retaining slots are provided to cooperate with retaining plates provided on the anti-slippage cover plate so that the threshold base can be positioned and secured in place. The end surface of the threshold base may be provided with an anti-slippage plate for cover and decoration and covering.

BRIEF DESCRIPTION OF THE DRAWINGS

The invention will be more fully understood from the following detailed description thereof, taken in conjunction with the accompanying drawings, in which.

DETAILED DESCRIPTION OF THE PREFERRED EMBODIMENT

Figure 1:
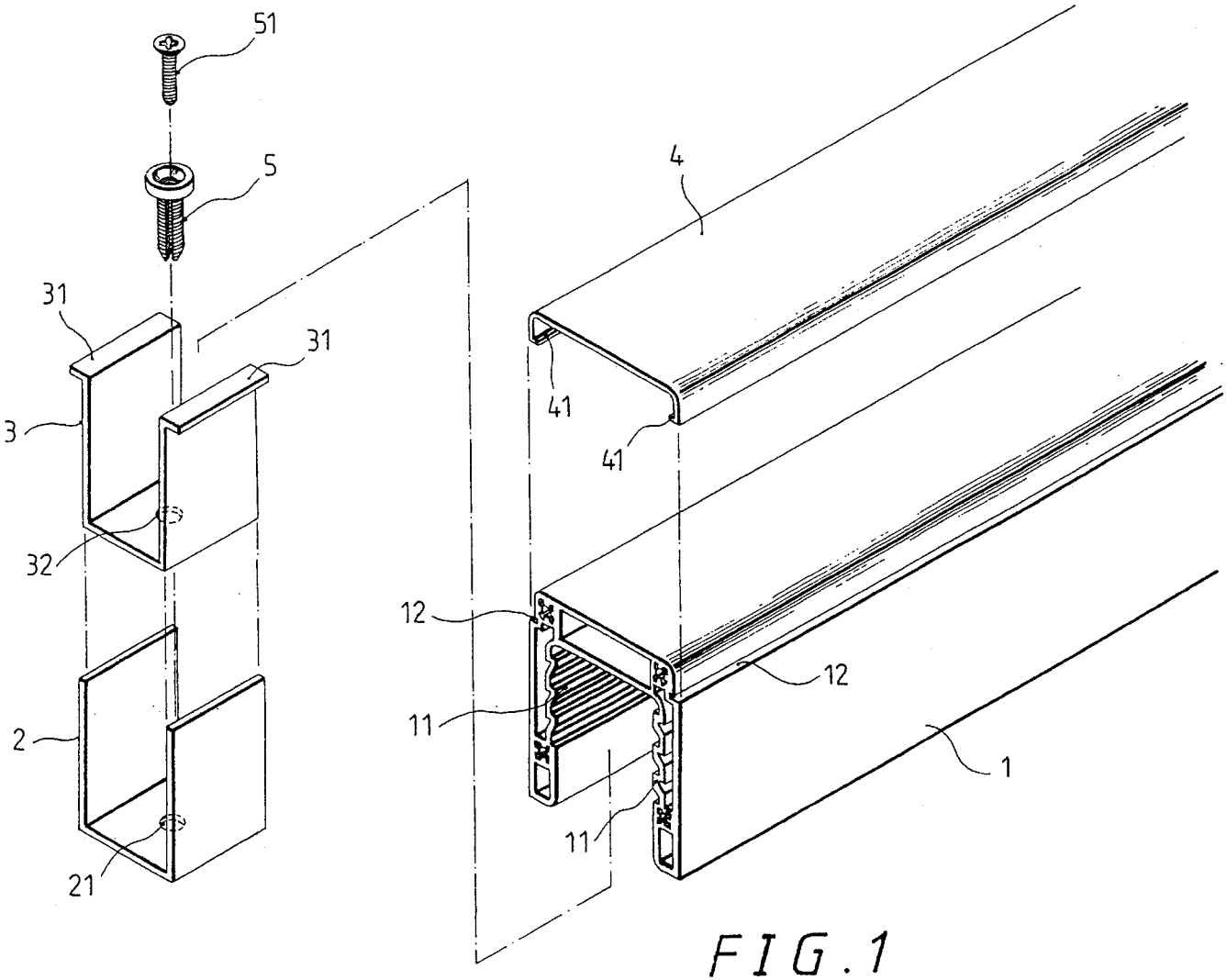
FIG. 1 is an exploded perspective view of a threshold assembly according to the present invention.

As shown in FIG. 1, the plastic threshold assembly according to the present invention consists of an elongate threshold base 1, an inner bushing 2, a securing plate 3 and an anti-slippage cover plate 4.

The threshold base 1 is a hollow body having the shape of an inverted "U" defined by a base wall and a pair of downwardly extending side walls, and is provided with appropriate thickness and strength. The base 1 can be formed into a double-layer plate body, so that suitable ribs can be provided for strengthening. On both inner sides of the side wall, longitudinal stepped tooth slots 11 having inverted hooks are provided. In selected outer sides of the side walls, longitudinal retaining grooves 12 are respectively provided.

The inner bushing 2 is also a plate body having the shape of an "U" defined by a base wall and a pair of upwardly extending side walls, with the base wall facing downward for engaging the ground, and a hole 21 provided in the base wall.

Figure 2:
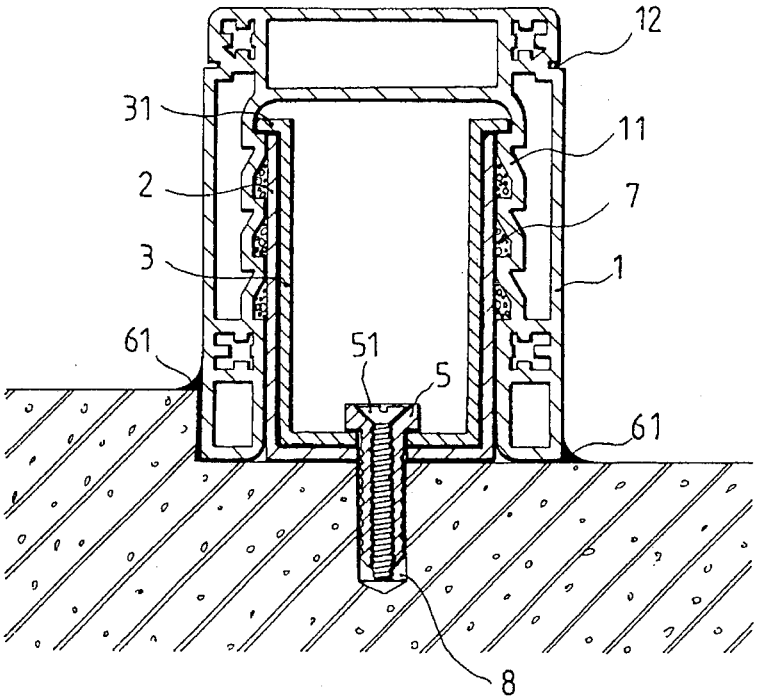
FIG. 2 is a cross-sectional view of an installed threshold assembly according to the present invention.
Figure 3:
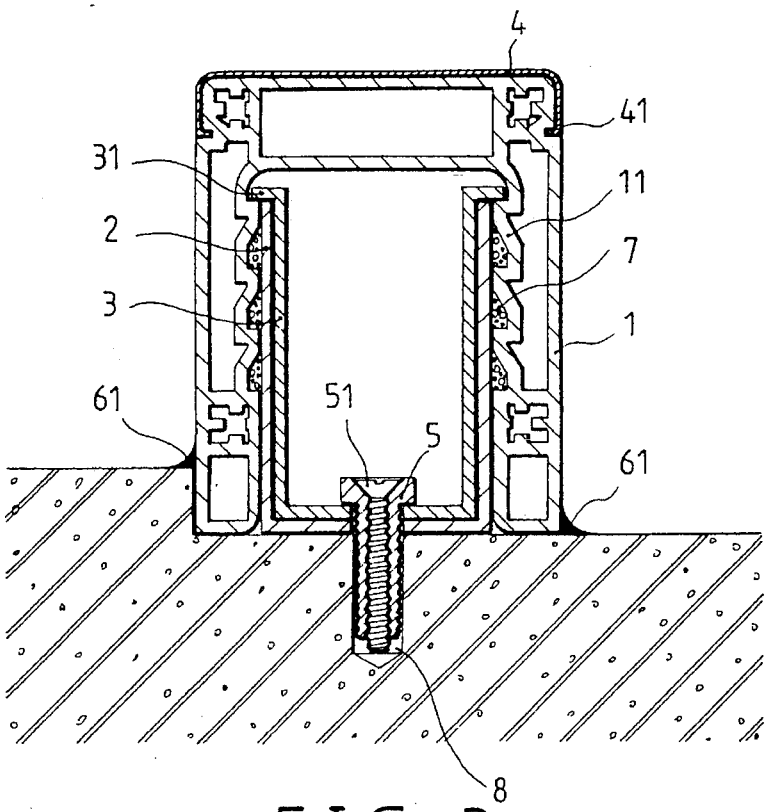
FIG. 3 is cross-sectional view of the installed threshold assembly having an anti-slippage plate.
Figure 4:
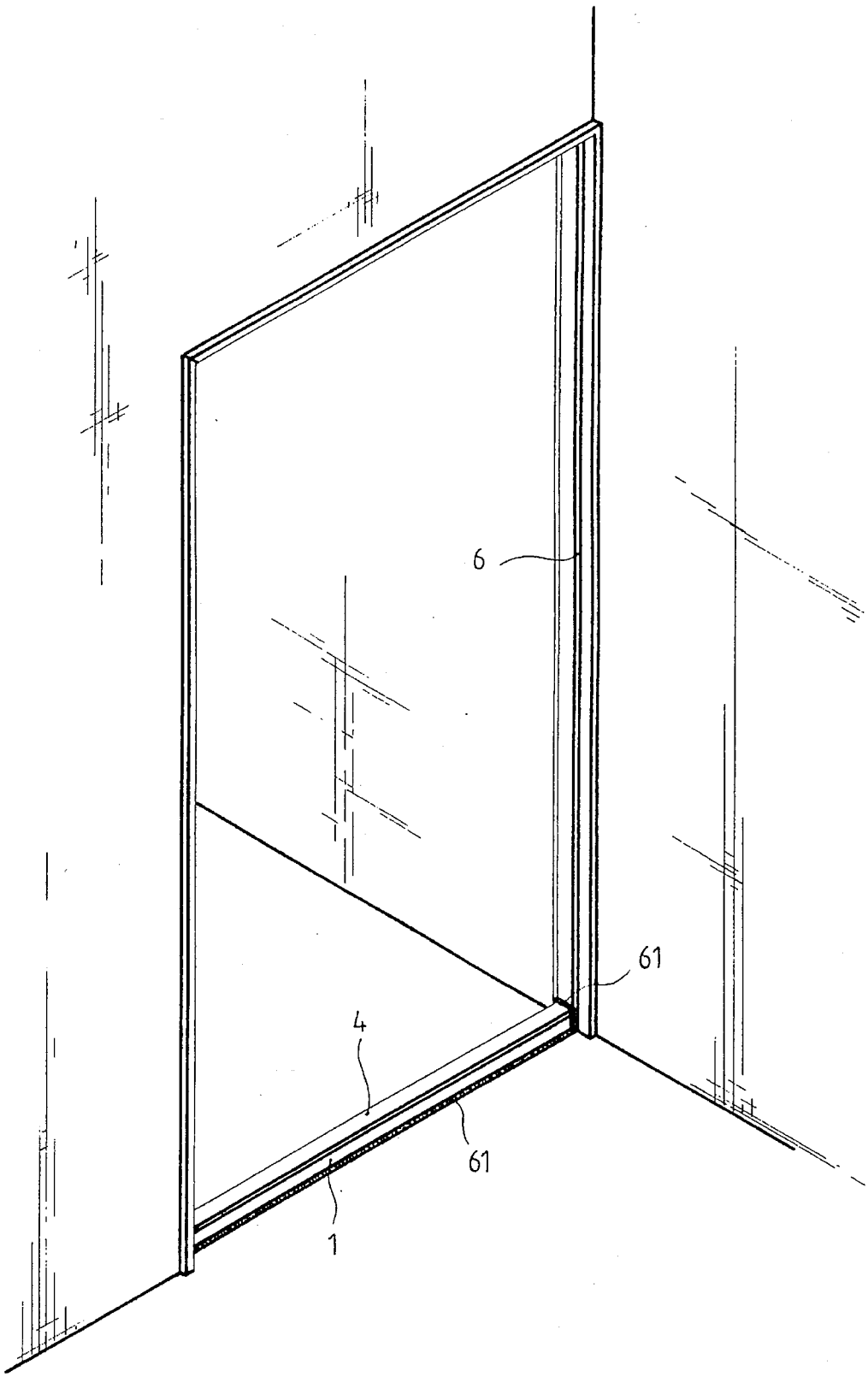
FIG. 4 is a perspective view of the threshold assembly installed with a door frame.

The securing plate 3 is also a plate body having the shape of an "U" defined by a base wall and a pair of upwardly extending side walls, and is made to be inserted into the above-mentioned inner bushing 2, as is shown in FIG. 2. Each side wall of the securing plate 3 is respectively provided with an outwardly extending retaining 31. The wall of plate 3 is also provided With a hole 32, which corresponds in alignment to hole 21 of the inner bushing 2.

The anti-slippage plate 4 is a cover plate having the shape of an inverted "U", with its two ends being each respectively provided with a retaining flange 41 facing inward. Its top surface can be appropriately fabricated into a rough surface (by use of protruded particles or patterns).

In assembly the above components, the securing plate 3 is first inserted into the inner bushing 2, and suitable fastening members 5 are used to feed through holes 21 and 32 so that they can be secured on the ground. The threshold base 1 is then pushed down, with appropriate pressure, to cover the exterior of the inner bushing 2. The retaining flanges 31 on both sides of the securing plate 3 are allowed to engage with the inverted hooks provided on step tooth slots 11. After the assembly, the joints between the threshold base 1 and the door frame 6 are sealed with a sealer 61 (such as silicone) to prevent leakage and water penetration through the joints. The overall structure is simple to assemble and can be completed quickly, and it does not require the wet-type construction such as the filling of concrete.

The above threshold base 1 is formed into an elongated body, the total length of which is determined by the dimension of the door frame. The inner bushing 2 and the securing plate 3 do not have to be the same length as the threshold base 1. They may be formed in two or three segments, so that each segment can be installed on the ground one at a time, thereby cooperating with threshold base 1 to provide a secured assembly. In addition, after the inner bushing 2 is secured on the ground, bonding glue 7 can be applied to its exterior wall. When the inner wall of threshold base 1 comes in contact with the exterior wall of inner bushing 2, the bonding glue is allowed to flow into the step toothed slots 11, providing a much stronger bonding effect.

The threshold base 1 and the inner bushing 2 of the plastic threshold according to the present invention are suitable to be molded from plastic. Not only is plastic lightweight and rugged, but also the product can be produced in quantity to lower the cost. As for the securing plate 3, it should be made from metallic materials because of the retaining effect and the supporting strength required. The material for the anti-slippage plate 4 can be determined by practical needs. It is hereby point out that the use of materials is simply a matter of substitution.

In addition, the retaining grooves 12 provided on both exterior walls of threshold base 1 are used to cooperate with the anti-slippage plate 4 for covering. The end surface of the threshold base 1 can also be provided with a rough surface to replace the anti-slippage plate 4. This is another embodiment that does not depart from the scope of the invention. In addition, the fastening members 5 shown in FIG. 1 can be a hollow anchor, which can be driven into the ground hole 8. When the bolt 51 is driven into the anchor, the latter expands and provides a tight gripping. Nonetheless, the fastening members 5 can also be substituted by other means of securing device.

The design of the structure according to the present invention is to provide the dry-type construction for the water-blocking threshold, and is particularly suitable to be installed after the construction and painting of the door frame and walls are completed. The structure provides a quick construction process, and prevents the water-blocking threshold to be contaminated with paint and cement. The overall structure is very reasonable, and provides a simplified and secured effect.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A threshold assembly comprising:

a) a hollow elongate base having an inverted U-shaped configuration defined by a base wall and a pair of downwardly extending side walls, each side wall including an inner surface and an outer surface, and a plurality of hooks provided on the inner surface of each side wall;

b) an inner bushing having a U-shaped configuration defined by a base wall for engaging a ground surface and a pair of upwardly extending side walls, and a hole formed in the base wall;

c) a securing plate having a U-shaped configuration defined by a base wall and a pair of upwardly extending side walls, the base wall including a hole formed therein, the securing plate being receivable within the inner bushing for aligning the hole in the base wall of the inner bushing with the hole in the base wall of the securing plate to receive a fastener therethrough for securing the inner bushing and the securing plate to the ground, and each side wall of the securing plate including an upper end provided with an outwardly extending flange; and d) wherein after the inner bushing and securing plate are secured to the ground by the fastener, the base may be pushed downwardly over the inner bushing and securing plate to permit the outwardly-extending flanges of the securing plate to engage the hooks of the base, thereby securing the base to the inner bushing and securing plate.

2. The threshold assembly of claim 1 wherein the base wall and side walls of the elongate base are each in the form of a double-layered plate body.

3. The threshold assembly of claim 1 further including:

a) a pair of retaining grooves extending along opposite sides of the elongate base; and b) a cover plate including a pair of inwardly directed flanges engageable within the retaining grooves.

4. The threshold assembly of claim 1 further including bonding glue for securing the inner bushing to the side walls of the threshold base.

5. The threshold assembly of claim 1 whereby the threshold assembly forms joints with the ground surface when the threshold assembly is secured thereto, and further including silicone for sealing the joints.

* * * * *